US007540942B2

(12) United States Patent
Hikita

(10) Patent No.: US 7,540,942 B2
(45) Date of Patent: Jun. 2, 2009

(54) PRESS BELT AND SHOE PRESS ROLL

(75) Inventor: Takahisa Hikita, Yawata (JP)

(73) Assignee: Yamauchi Corporation, Osaka (JP)

( * ) Notice: Subject to any disclaimer, the term of this patent is extended or adjusted under 35 U.S.C. 154(b) by 349 days.

(21) Appl. No.: 10/573,321

(22) PCT Filed: Sep. 13, 2004

(86) PCT No.: PCT/JP2004/013327

§ 371 (c)(1),
(2), (4) Date: Mar. 24, 2006

(87) PCT Pub. No.: WO2005/028748

PCT Pub. Date: Mar. 31, 2005

(65) Prior Publication Data

US 2007/0029062 A1 Feb. 8, 2007

(30) Foreign Application Priority Data

Sep. 24, 2003 (JP) ..... 2003-331764

(51) Int. Cl.
*D21F 3/02* (2006.01)

(52) U.S. Cl. ..... 162/358.4; 162/901; 428/167

(58) Field of Classification Search ..... 162/204, 162/205, 358.1, 358.3, 358.4, 901; 428/163, 428/167

See application file for complete search history.

(56) References Cited

U.S. PATENT DOCUMENTS

| | | | | |
|---|---|---|---|---|
| 4,880,501 A | | 11/1989 | Schiel | |
| 5,543,015 A | * | 8/1996 | Jermo | 162/358.4 |
| 6,296,738 B1 | * | 10/2001 | Ishii | 162/358.4 |
| 6,416,630 B1 | * | 7/2002 | Matuschczyk et al. | 162/358.4 |
| 7,374,640 B2 | * | 5/2008 | Romanski | 162/358.4 |

FOREIGN PATENT DOCUMENTS

| | | |
|---|---|---|
| CA | 1224657 | 7/1987 |
| CA | 2088005 | 1/1992 |
| DE | 3727563 | 2/1989 |
| DE | 3827486 A1 | 2/1990 |
| EP | 0 953 678 A2 | 11/1999 |
| EP | 04773009.8 | 1/2007 |
| FI | 882992 | 2/1989 |
| GB | 2208879 | 4/1989 |
| JP | 61179359 | 7/1986 |
| JP | 1061591 | 3/1989 |

(Continued)

OTHER PUBLICATIONS

PCT/JP2004/013327, International Preliminary Report on Patentability, Jun. 8, 2006.

(Continued)

*Primary Examiner*—Eric Hug
(74) *Attorney, Agent, or Firm*—Ditthavong Mori & Steiner, P.C.

(57) ABSTRACT

A press belt (2) comprises many drain grooves (13) extending along a belt travel direction, and many lands (14) positioned between the adjacent drain grooves and extending along the belt travel direction. The land (14) has an upper surface which is entirely curved upward as a transverse sectional configuration along a belt width direction.

6 Claims, 5 Drawing Sheets

FOREIGN PATENT DOCUMENTS

| | | | |
|---|---|---|---|
| JP | H01-36960 | Y | 11/1989 |
| JP | 10510594 | T | 4/1996 |
| JP | 11335992 | | 11/1999 |
| JP | 2005-97806 | | 4/2005 |
| KR | 10-2006-0034728 | | 4/2006 |
| KR | 10-2006-7003266 | | 12/2006 |
| SE | 8802510 | | 2/1989 |
| WO | WO 96/12065 | | 4/1996 |
| WO | WO 2004/110729 | A2 | 12/2004 |

OTHER PUBLICATIONS

Office Action for Canadian Application No. 2,539,614, mailed Sep. 19, 2007.

* cited by examiner

PRESS BELT AND SHOE PRESS ROLL

TECHNICAL FIELD

The present invention relates to a press belt and shoe press roll used for pressing an object to be pressed in a field of a papermaking industry and the like.

BACKGROUND ART

A belt press, in which a continuous long object to be pressed is put on a press belt, and the object to be pressed is pressed between one pressing member positioned inside a periphery of the press belt and the other pressing member positioned outside the periphery of the press belt, has been used in various kinds of industries. Here, the pressing means includes a press roll and a pressure shoe. For example, the belt press includes a shoe press as a dehydrating press in the papermaking industry.

The shoe press will be briefly described, taking the papermaking industry for example. That is, the shoe press is a pressing (dehydrating) operation in which a surface pressure is applied to an object to be pressed (wet paper web) on an outer periphery of a press belt between a press roll positioned outside a periphery of the press belt serving as external pressing means and a pressure shoe positioned inside the periphery of the press belt serving as internal pressing means through the press belt. While a linear pressure is applied to the object to be pressed in the roll press using two rolls, a area pressure can be applied to the object to be pressed using the pressure shoe having a predetermined width in a travel direction in the shoe press. Therefore, when a dehydrating press is performed by the shoe press, since a nip width can be large, hydrating efficiency can be improved.

In order to make the shoe press compact, a shoe press roll in which a pressure shoe serving as internal pressing means is covered with a flexible cylindrical press belt (press jacket) to be assembled to have a rolled shape has been widely used as disclosed in Japanese Unexamined Patent Publication No. 61-179359, for example.

Characteristics required for the press belt includes strength, abrasion resistance, flexibility and impermeability to water, oil, gas and the like in general. As a material comprising the above characteristics, polyurethane provided by a reaction between urethane prepolymer and a curing agent has been used for the press belt in general.

In a papermaking technique, it is known that many drain grooves extending along a belt travel direction are formed in an external surface of the press belt in order to drain water squeezed from the pressed wet paper web.

FIG. 10 is a sectional view showing a conventional press belt having typical drain grooves. An illustrated press belt 80 comprises many drain grooves 81 extending along a belt travel direction, and many lands positioned between the adjacent drain grooves and extending along the belt travel direction. Each of the drain groove 81 and the land 82 has a rectangular section in a belt width direction in general.

FIG. 11 shows a state in which a wet paper web 84 to be pressed and a felt 83 are sandwiched between the press belt 80 and a press roll 85. This state is a state before pressed. An upper surface of the land 82 is flat and this flat upper surface is in surface contact with the felt 83.

As the press is performed from the state shown in FIG. 11, an upper part of the land 82 is pressed downward and swelled sideways as shown in FIG. 12B. Thus, an opening of the drain groove is reduced in size and a dehydrating performance (draining performance) is lowered.

FIG. 12A shows a pressure distribution on the wet paper web, corresponding to FIG. 12B. According to the pressure distribution on the wet paper web, although a pressure is not applied to a part above the drain groove 81, a high pressure is applied to a part on the land 82. Since the land 82 has the flat upper surface, the same high pressure is applied to a part having a certain degree of width and the pressure is abruptly reduced at both ends of the width, that is, a boundary between the drain groove 81 and the land 82.

Such large pressure difference causes a paper web component to be changed. More specifically, an orientation difference of fiber, a yield difference of a filler, a volume difference and the like are generated. Since such change in paper web component is quite noticeable at the part on the boundary between the drain groove 81 and the land 82, a groove mark extending along the belt travel direction appears at this boundary. The groove mark lowers a paper quality.

In addition, since the flat upper surface of the land 82 comes in surface contact with the wet paper web 84 through the felt 83 at high pressure, water is captured in the flat upper surface and cannot be drained to the drain groove, so that the dehydrating performance could deteriorate. In addition, as shown in FIG. 12B, since the drain groove is large on the bottom but small in the middle part, the water in the drain groove 81 is not likely to be discharged. Thus, the press belt 80 containing water comes in contact with the wet paper web again because the water is not drained. When such phenomenon is generated, the wet paper web is not dehydrated and the paper is further moistened.

According to a press belt disclosed in Japanese Utility Model Publication No. 1-36960, in order to prevent an opening of a drain groove from being closed because a press belt is deformed at the time of pressing, a lateral width of an opening of the groove is formed wider than that of the bottom of the groove. According to a press belt disclosed in Japanese National Publication of International Application No. 10-510594, in order to reduce closure of a drain groove at the time of pressing, both side walls of the groove gradually upwardly diverge. In addition, a press belt disclosed in Japanese Unexamined Patent Publication No. 11-335992, in order to maintain a water retention volume as large as possible, a slope to increase an opening width is formed in an opening region of a side wall of a drain groove.

Even when the press belt has drain grooves to improve the draining performance, since the land between the grooves has the flat upper surface, the paper component is inevitably changed due to the large pressure difference at the boundary between the land and the groove. In addition, the problem in which water is captured in the flat upper surface cannot be solved.

DISCLOSURE OF THE INVENTION

The present invention was made to solve the above problems and it is an object of the present invention to provide a press belt in which its dehydrating performance is excellent and a change in paper component is minimized.

It is another object of the present invention to provide a shoe press roll using the above press belt as an external cylinder.

A press belt according to the present invention is endlessly rotated and used in a press apparatus in which an object to be pressed is put on an outer periphery of the press belt and it is pressed by pressing means provided inside and/or outside a periphery of the press belt and having a predetermined width. The press belt comprises many drain grooves extending along a belt travel direction and many lands positioned between the adjacent grooves and extending along the belt travel direction. Each land has an upper surface which is entirely curved upwardly as a transverse sectional configuration along a belt width direction.

According to the above constitution of the present invention, since the upper surface of the land is entirely curved upwardly, a distribution of the pressure applied to the press belt becomes gentle at the time of pressing. As a result, since a change in pressure on the paper to be pressed is not abrupt but gentle, a change in paper component becomes gentle. Therefore, a groove mark is prevented from appearing on a paper surface.

In addition, since the land is prevented from being enlarged sideways at the time of pressing, an opening of the drain groove can be prevented from being narrowed, so that preferable dehydrating performance and draining performance can be maintained. In addition, since water is pushed from the top of the land to its sides at the time of pressing, the water is not captured in the upper part of the land.

According to one embodiment, the transverse sectional configuration of the land is an upward parabolic configuration. Furthermore, side walls on both sides of the land may be tapered so that their width is reduced toward the upper side in order to provide the more preferable dehydrating performance and the draining performance.

According to another embodiment, the upper surface of the land may comprise a linear part on its top as a transverse sectional configuration along the belt width direction. In this case, in order to provide a gentle pressure distribution and the preferable hydrating performance and the draining performance, when it is assumed that a width of the linear part is "s" and a width of the land is "W", a relation between them is such that $s/W < 0.5$.

A shoe press roll according to the present invention comprises an external cylinder comprising the endless press belt having the above characteristics and a pressure shoe positioned inside a periphery of the external cylinder serving as pressing means.

BEST MODE FOR CARRYING OUT THE INVENTION

An embodiment of the present invention will be described with reference to the drawings hereinafter.

Figure 1:
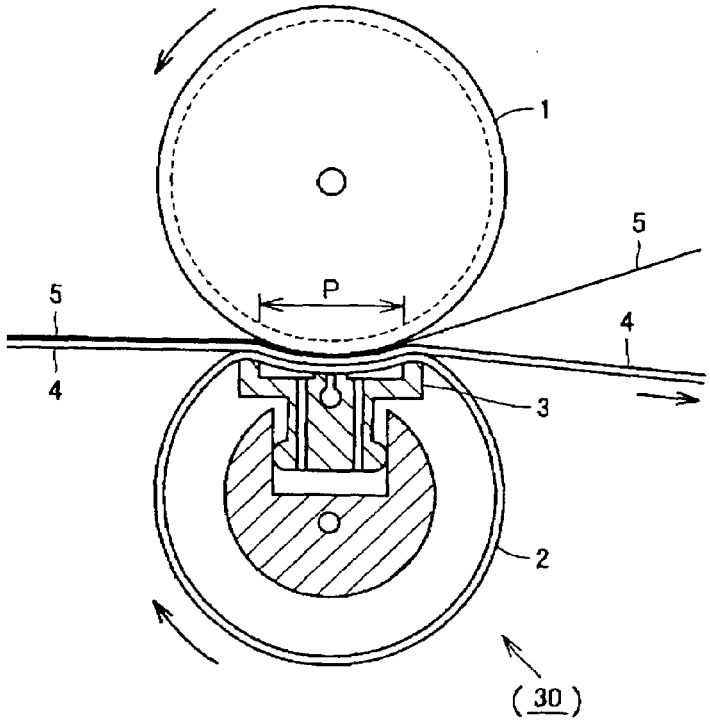
FIG. 1 is a sectional view showing a shoe press apparatus taken along a travel direction, used in a pressing process in a paper machine.

FIG. 1 is a sectional view showing a shoe press apparatus taken along a travel direction, which is used in a pressing process in a paper machine. The shoe press apparatus comprises a press roll serving as pressing means 1, a press belt 2 opposed to the press roll 1, and a pressure shoe serving as pressing means 3 positioned inside a periphery of the press belt 2. In addition, although a shoe press roll 30 is so constituted that the pressure shoe 3 is covered with the press belt 2 and the press belt 2 is assembled so as to be in the form of an external cylinder in FIG. 1, the press belt 2 is not necessarily rolled and it may be used as an endless belt as it is.

The press roll 1 is provided outside the periphery of the press belt 2 and functions as one pressing means. The pressure shoe 3 is provided inside the periphery of the press belt 2 and functions as the other pressing means. A wet paper web 5 to be pressed together with a felt 4 is passed through a part between the press belt 2 and the press roll 1. The outer periphery surface of the press belt 2 is directly in contact with the felt 4.

A lubrication oil is supplied between the press belt 2 and the pressure shoe 3, so that the press belt 2 can slide on the pressure shoe 3. The press roll 1 is rotated so that the press belt 2 is rotated by friction force with the traveling felt 4, sliding on the pressure shoe 3.

The pressure shoe 3 is pressed from the inside of the periphery of the press belt 2 toward the press roll 1, and the wet paper web 5 is pressed by this pressing force and dehydrated. A surface of the pressure shoe 3 is dented so as to correspond to a surface of the press roll 1. Therefore, a pressure dehydrating part P having a large width in the travel direction is formed between the press roll 1 and the press belt 2.

Figure 2:
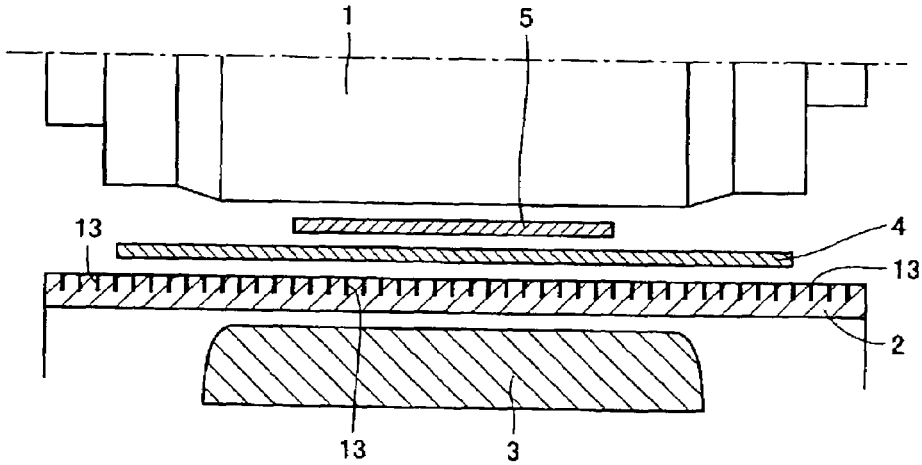
FIG. 2 is a sectional view showing an essential part of a pressure dehydrating part P taken along a width direction in FIG. 1.

FIG. 2 is a sectional view showing an essential part of the pressure hydrating part P in FIG. 1 taken along a width direction. As shown in FIG. 2, each of the press roll 1 and the pressure shoe 3 has a predetermined length in the width direction.

Figure 3A:
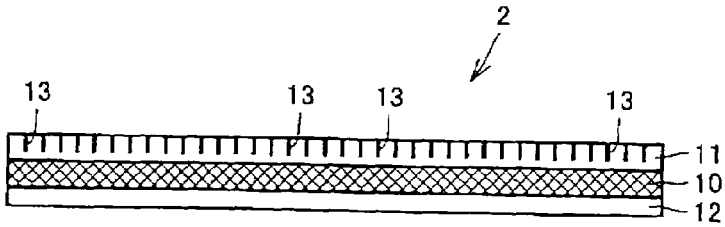
FIG. 3A is a sectional view showing a press belt according to one embodiment of the present invention.
Figure 3B:
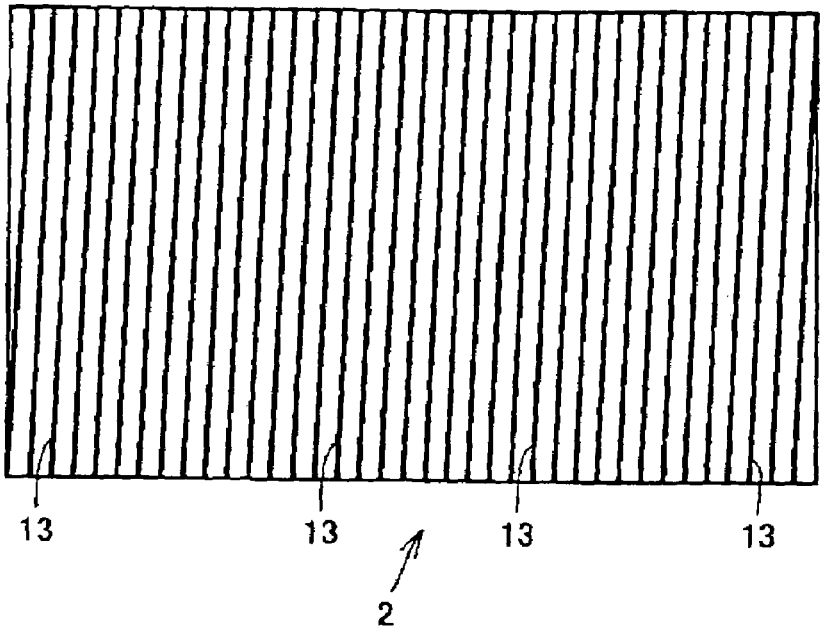
FIG. 3B is a plan view showing the press belt according to one embodiment of the present invention.

FIGS. 3A and 3B are views showing an example of the press belt 2, in which FIG. 3A is its sectional view and FIG. 3B is its plan view. The press belt 2 comprises a reinforcing layer 10 in which an endless reinforcing base material is impregnated with an elastic material, an upper elastic layer 11 positioned on the outer periphery surface of the reinforcing layer 10 and integrated with the reinforcing base material impregnated with the elastic material of the reinforcing layer 10, and a lower elastic layer 12 positioned on the inner periphery surface of the reinforcing layer 10 and integrated with the reinforcing base material impregnated with the elastic material of the reinforcing layer 10.

As the reinforcing base material which constitutes the reinforcing layer 10, a woven cloth comprising an organic fiber such as polyamide or polyester is used. The entire belt 2 is integrally formed of an elastic material such as thermosetting polyurethane and the reinforcing material is buried in the belt 2.

As shown in FIG. 3, many drain grooves 13 extending along the belt travel direction are formed in an outer periphery surface of the upper elastic layer 11. The drain grooves 13 extend spirally over the entire press belt 2 in the width direction.

Figure 4:
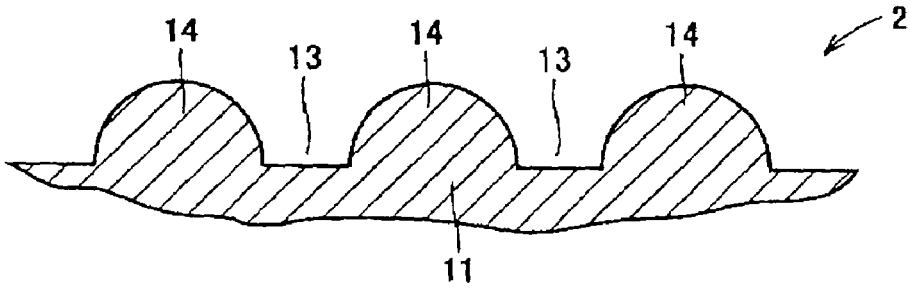
FIG. 4 is an enlarged sectional view showing an essential part of the press belt according to one embodiment of the present invention.

FIG. 4 is an enlarged sectional view showing the upper elastic layer 11 of the press belt 2. The press belt 2 comprises the drain grooves 13 extending along the belt travel direction and lands 14 positioned between the adjacent drain grooves 13 and extending along the belt travel direction. As shown in FIG. 4, the land 14 is formed such that its upper surface is entirely curved upward as its transverse sectional configuration along the width direction of the belt. According to the embodiment shown in FIG. 4, a transverse sectional configuration of the land 14 is a semicircle. However, the transverse sectional configuration of the land 14 is not limited to the semicircle and it may be an upward parabolic configuration.

Figure 5:
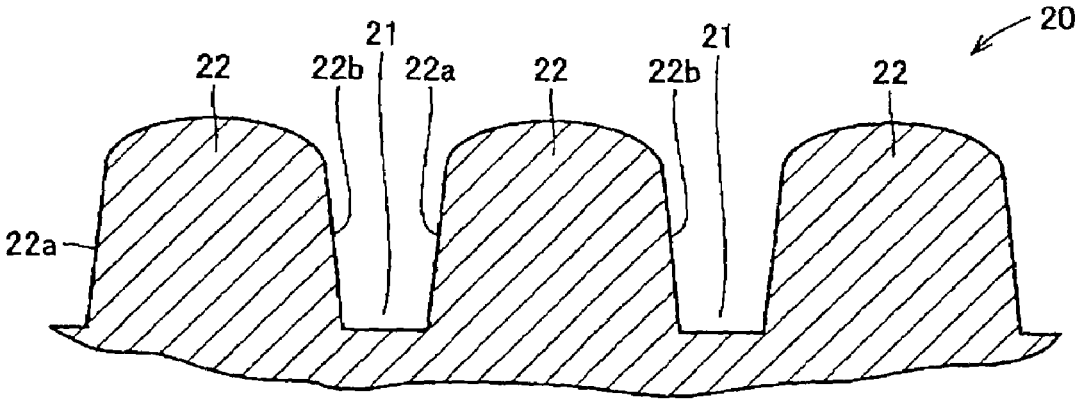
FIG. 5 is an enlarged sectional view showing an essential part of a press belt according to another embodiment of the present invention.

FIG. 5 is an enlarged sectional view showing a press belt 20 according to another embodiment. The press belt 20 comprises drain grooves 21 and lands 22. The land 22 is formed such that its upper surface is curved upward gently and its side walls 22*a* and 22*b* on both sides are tapered such that their width becomes small toward the upper side.

Figure 6:
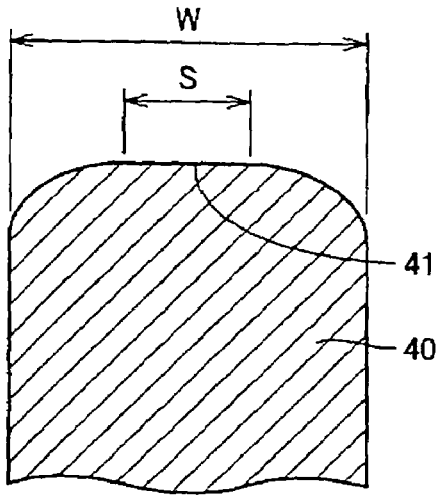
FIG. 6 is an enlarged sectional view showing an essential part of a press belt according to still another embodiment of the present invention.

According to each embodiment of the present invention, the land of the press belt has to have an upwardly curved upper surface. Here, the term "upwardly curved upper surface" comprises not only a perfect curved surface having no flat part, but also a curved surface having a small flat part. FIG. 6 is an enlarged sectional view showing a land 40 having such configuration. That is, an upper surface of the land 40 comprises a linear part 41 on its top as a transverse sectional configuration along the belt width direction. According to this embodiment, in order to provide a gentle pressure distribution, a preferable dehydrating performance and draining performance, when it is assumed that a width of the linear part 41 is "s", and a width of the land 40 is "W", a relation has to be such that $s/W < 0.5$. Preferably, it is such that $s/W \leqq 0.3$ and more preferably, it is such that $s/W \leqq 0.1$.

Figure 7:
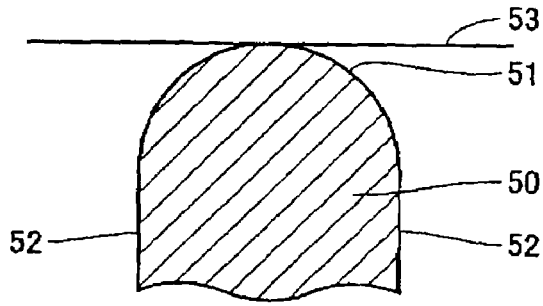
FIG. 7 is an enlarged sectional view showing an essential part of a press belt according to still another embodiment of the present invention.
Figure 8:
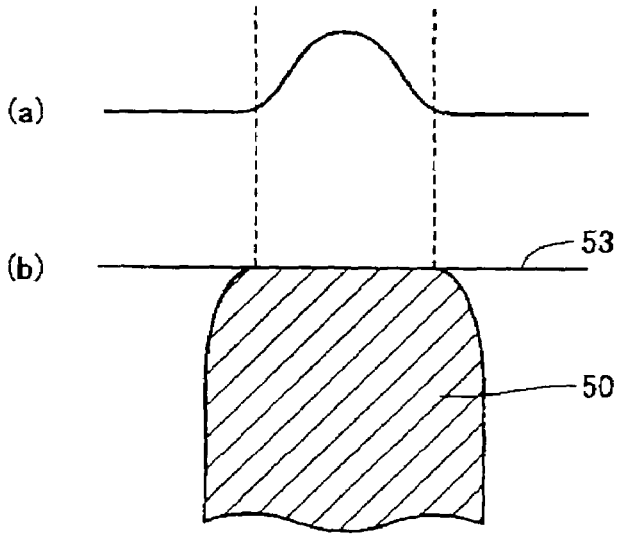
FIG. 8 is a view showing a pressed state and a pressure distribution of the press belt shown in FIG. 7.

A land 50 of a press belt shown in FIG. 7 comprises a semicircular upper surface 51 and parallel side walls 52 on its both sides. FIG. 7 shows the land 50 before pressed and FIG. 8(*b*) shows the pressed land 50. FIG. 8(*a*) shows a pressure distribution to the wet paper web, corresponding to FIG. 8(*b*).

As shown in FIG. 7, only the top of the land 50 abuts on the object 53 to be pressed (a wet paper web or a felt) in a state just before pressed. Then, as a pressing operation is performed from this state, the land 50 is pressed and an area abutting on the object 53 to be pressed gradually becomes large. Thus, as shown in FIG. 8(*b*), in a pressed state, the pressure distribution applied to the object 53 is gently changed. As a result, since the pressure applied to the paper on a boundary between the land 50 and drain groove is not changed abruptly, but changed gently, a paper web component is gently changed. As a result, a groove mark is prevented from appearing on the surface of the paper web.

In addition, since the upper surface of the land is curved upward, the land is prevented from being enlarged sideways when pressed, so that an opening part of the drain groove is prevented from being narrowed. In addition, at the time of pressing, since water is pushed from the top to the sides of the land 50, the water is not captured in the upper part of the land.

Figure 9:
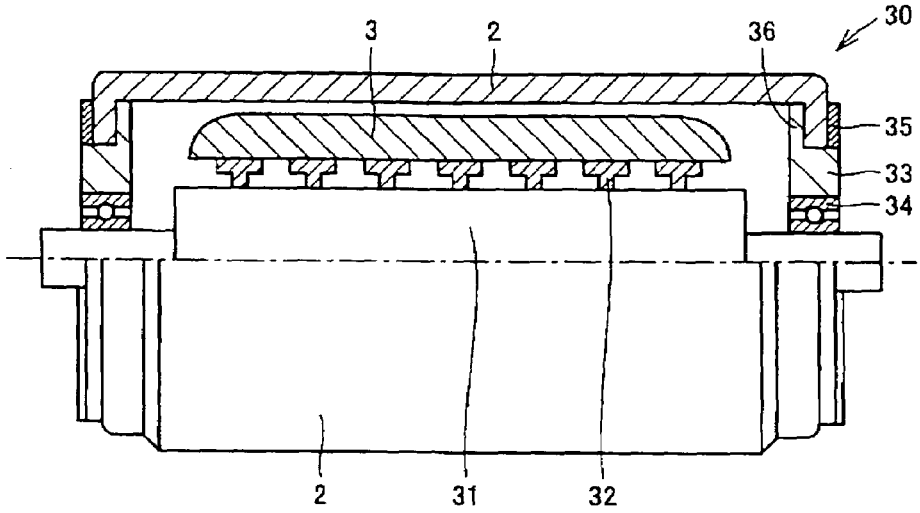
FIG. 9 is a sectional view showing a shoe press roll taken along a width direction according to one embodiment of the present invention.
Figure 10:
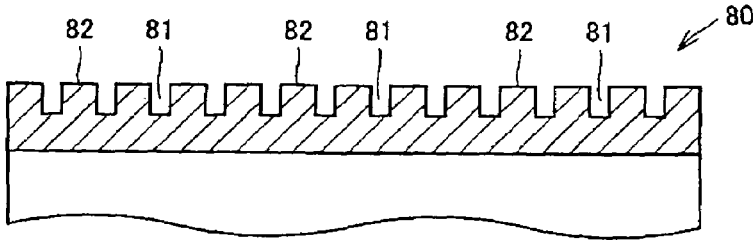
FIG. 10 is a sectional view showing a conventional press belt.
Figure 11:
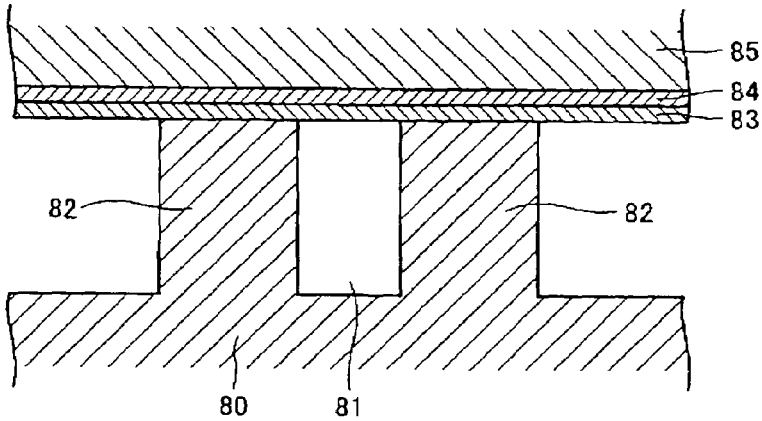
FIG. 11 is a view showing a state just before the conventional press belt is pressed.
Figure 12A:
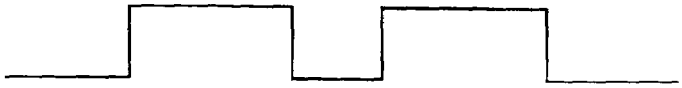
FIG. 12A is a view showing a pressure distribution of the conventional press belt.
Figure 12B:
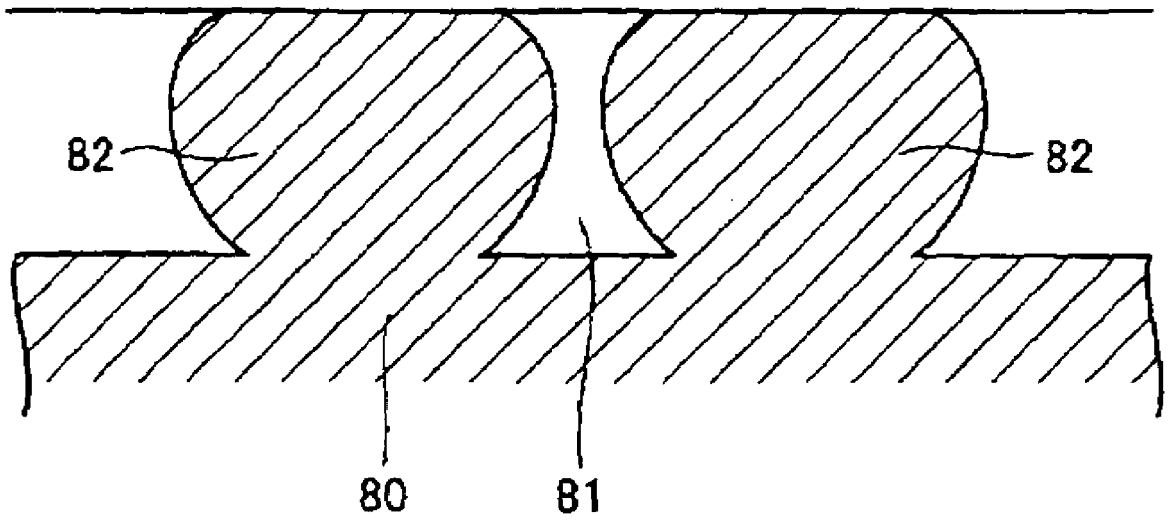
FIG. 12B is a view showing a pressed state of the conventional press belt.

Next, an embodiment of the shoe press roll 30 according to the present invention will be described with reference to FIG. 9. FIG. 9 is a sectional view showing the shoe press roll taken along a width direction. According to the shoe press roll 30, the pressure shoe 3 serving as the pressing means is covered with the press belt 2 and the press belt 2 is rolled as an external cylinder. Although the press belt 2 has drain grooves and lands as described in the above each embodiment, they are not shown in FIG. 9 for simplification.

The pressure shoe 3 is supported on a supporting shaft 31 by a hydraulic cylinder 32 and it can press the press belt upwardly. An end disk 33 is rotatably supported on the both ends of the supporting shaft 31 through a bearing 34. An edge of the press belt 2 is bent inward in a radial direction on an outer periphery 36 of the end disk 33. The bent part of the edge of the press belt 2 is sandwiched between the outer periphery of the end disk 33 and a ring-shaped fixed plate 35 and fixed by a clincher and the like. The lubrication oil is supplied between the press belt 2 and the pressure shoe 3. Thus, the press belt 2 fixed to the end disk 33 can be rotated, sliding on the pressure shoe 3.

Although the embodiments of the present invention have been described with reference to the drawings in the above, the present invention is not limited to the above-illustrated embodiments. Various kinds of modifications and variations may be added to the illustrated embodiments within the same or equal scope of the present invention.

INDUSTRIAL APPLICABILITY

According to the press belt in the present invention, a dehydrating performance and a draining performance are excellent, and a groove mark is prevented from appearing by applying a gentle pressure distribution to the paper web. Thus, the present invention can be advantageously employed in a press belt and a shoe press roll used for pressing an object to be pressed in a paper machine.

The invention claimed is:

1. A press belt in a pressing apparatus comprising the press belt rotated endlessly and pressing means provided inside and/or outside a periphery of the press belt, said press belt comprising:

many drain grooves extending along a belt travel direction; and many lands positioned between the adjacent grooves and extending along the belt travel direction, wherein said land has an upper surface which is curved upwardly as a transverse sectional configuration along a belt width direction, wherein said lands are spaced apart from each other by the groove therebetween, wherein said upper surface of the land comprises a linear part on its top as a transverse sectional configuration along the belt width direction, and wherein a width of said linear part is defined as "s" and a width of the land is "W", and a relation between them is such that $s/W<0.5$.

2. The press belt according to claim 1, wherein said transverse sectional configuration of the land is an upward parabolic configuration.

3. The press belt according to claim 1, wherein side walls on both sides of said land are tapered so that their width is reduced toward the upper side.

4. The press belt according to claim 1, wherein $s/W \leqq 0.3$.

5. The press belt according to claim 1, wherein $s/W \leqq 0.1$.

6. A shoe press roll comprising an external cylinder comprising an endless press belt, and a pressure shoe positioned inside a periphery of said external cylinder as pressing means, wherein said external cylinder is the press belt according to claim 1.

* * * * *